US005216446A

United States Patent [19]

Satoi et al.

[11] Patent Number: 5,216,446

[45] Date of Patent: Jun. 1, 1993

[54] INK JET HEAD, INK JET CARTRIDGE USING SAID HEAD AND INK JET RECORDING APPARATUS USING SAID CARTRIDGE

[75] Inventors: Tsunenobu Satoi, Yokohama; Kunihiko Maeoka, Kawasaki; Seiichiro Karita, Yokohama; Hiroshi Nakagomi, Yamato, all of Japan

[73] Assignee: Canon Kabushiki Kaisha, Tokyo, Japan

[21] Appl. No.: 474,370

[22] Filed: Feb. 2, 1990

[30] Foreign Application Priority Data

Feb. 3, 1989 [JP] Japan ..... 1-025546

[51] Int. Cl.[5] ..... B41J 2/01; B41J 2/175

[52] U.S. Cl. ..... 346/140 R

[58] Field of Search ..... 346/140 R, 75

[56] References Cited

U.S. PATENT DOCUMENTS

| | | | |
|---|---|---|---|
| 4,257,052 | 3/1981 | Stoneburner | 346/75 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,500,895 | 2/1985 | Buck et al. | 346/140 R |
| 4,558,333 | 12/1985 | Sugitani et al. | 346/140 R |
| 4,580,147 | 4/1986 | De Young et al. | 346/140 R |
| 4,611,219 | 9/1986 | Sugitani et al. | 346/140 |
| 4,635,077 | 1/1987 | Itoh | 346/140 R |
| 4,695,851 | 9/1987 | Terasawa | 346/140 |
| 4,707,705 | 11/1987 | Hara et al. | 346/75 |
| 4,712,172 | 12/1987 | Kiyohara et al. | 346/1.1 |
| 4,723,129 | 2/1988 | Endo et al. | 346/140 R |
| 4,740,796 | 4/1988 | Endo et al. | 346/1.1 |
| 4,970,532 | 11/1990 | Komuro et al. | 346/140 R |

FOREIGN PATENT DOCUMENTS

| | | | |
|---|---|---|---|
| 0125742 | 11/1984 | European Pat. Off. . | |
| 0178889 | 4/1986 | European Pat. Off. . | |
| 0040565 | 4/1981 | Japan | 346/140 PD |
| 59-089164 | 5/1984 | Japan . | |
| 59-123670 | 7/1984 | Japan . | |
| 59-138461 | 8/1984 | Japan . | |
| 61-255863 | 4/1986 | Japan . | |
| 61-130052 | 6/1986 | Japan . | |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording head includes a substrate and a ceiling plate constituting discharge ports for discharging ink and ink passages which become pathways for the ink discharged from the discharge ports, said substrate having a heat energy generating member for generating heat energy to be utilized for discharging of ink; and an ink storage portion which stores ink discharged from said discharge ports, and also is equipped with said substrate at a part thereof, said ink storage portion and said substrate being insert molded to be constituted integrally.

11 Claims, 4 Drawing Sheets

INK JET HEAD, INK JET CARTRIDGE USING SAID HEAD AND INK JET RECORDING APPARATUS USING SAID CARTRIDGE

BACKGROUND OF THE INVENTION

1. Field of the invention

This invention relates to an ink jet head which performs recording by jetting a liquid to form flying droplets, an ink jet cartridge by use of said head and an ink jet recording head by use of said cartridge.

2. Related background art

Ink jet heads utilizing the method of generating heat energy by use of an electrothermal transducer and imparting the energy to ink, thereby causing abrupt change in the state accompanied with formation of bubbles of ink to discharge ink through discharge droplets and form flying droplets, can be easily made compact in size, light in weight, higher in density of discharge ports to be arranged in large numbers, and higher in precision. And, such ink jet heads utilizing heat energy have attached attention in recent years, because they are suitably adapted for color formation, cartridge formation of the so called disposable type, etc.

However, when high speed recording has been practiced by use of a large number of electrothermal transducing elements arranged at high density, the heat energy not utilized directly may be gradually accumulated in some cases. Such heat may have the undesired effect of heating unnecessarily the ink in fine liquid passages, thereby causing viscosity changes to occur, or release of the dissolved gas in the ink to generate unnecessary fine bubbles in some cases.

Accordingly, the present inventors have considered transmitting the heat accumulated in the substrate to the air, the storing portion for the ink (e.g. ink tank), etc. so as to reduce the influence of such unnecessary ink heating given to the discharge performance of ink.

As the constitution of such an ink jet head, for example, as shown in FIG. 5, FIG. 6 and FIG. 7, there has been one in which the heat transmission member 3 to be utilized for transmitting the accumulated heat accumulated in the substrate is adhered to the second ink tank 1 with an ink-resistant adhesive 9, and then the substrate 2 (or so called heater board) having a heat-generating resistance layer to be utilized for discharging of ink formed thereon is adhered similarly with the adhesive 9 to transmit the heat accumulated in the substrate 2 to the second ink tank. For preventing the head of such constitution from ink leak through the adhered surface between the ink tank and the substrate 2 or the heat transmitting member, it is necessary to effect secure adhesion between the second ink tank and the heat transmitting member 3 or the substrate 2, and the adhesive 9 must be filled completely in the gap between the ink tank, heater board 2, the heat transmitting member 3. In addition, for transmitting the heat generated at the heater board 2 with good efficiency, it is necessary that the heater board 2 and the heat transmitting member 3 should be completely adhered to each other. Further, for the purpose of enhancing the shooting precision of the ink discharged from the discharge orifices of the ink jet head, particularly the discharge precision of the ink in shade recording or full-color recording performed by use of a plurality of heads, it is important to control the thickness of the adhesive layer for ensuring the assembling positional precision of the heater board.

However, it has been very difficult to control the amount of the adhesive coated and the coating position for satisfying both the objects of maintaining the positional precision of the heater board 2 relative to the second ink tank after adhesion and preventing ink leakage. In other words, for ensuring the mounting positional precision of the heater board 2, it is preferable that the adhesive 9 should not be preferably coated too thick. In contrast, for the purpose of preventing completely ink leakage, the adhesive should be preferably coated rather thicker. Whereas, if it is coated too thick, there is the fear that superfluous adhesive may be swelled out and flowed into the liquid passages or the ink tank, whereby the production yield of ink jet head may be lowered.

SUMMARY OF THE INVENTION

An object of the present invention is to provide an ink jet head satisfying both of preventing completely the ink leakage in an ink jet head constituted to transmit the heat generated in the heater board particularly to the storing portion of ink and ensuring the mounting positional precision of the heat transmitting member heater board, and also accomplishing improvement of heat transfer efficiency. It is also another object of the present invention to provide an ink jet head prepared by simplified production steps.

A further object of the present invention is to obtain an ink jet recording head comprising:

a substrate and a ceiling plate constituting discharge ports for discharging ink and ink passages which become pathways for the ink discharged from the discharge ports, said substrate having a heat energy generating member for generating heat energy to be utilized for discharging of ink; and an ink storage portion which stores ink discharged from said discharge ports, and also is equipped with said substrate at a part thereof, said ink storage portion and said substrate being insert molded to be constituted integrally.

Another object of the present invention is to provide an ink jet cartridge comprising:

an ink jet head, said ink jet head having a substrate and a ceiling plate constituting discharge ports for discharging ink and ink passages which become pathways for the ink discharged from the discharge ports, said substrate having a heat energy generating member for generating heat energy to be utilized for discharging of ink;

a second ink tank which stores the ink discharged from said discharge ports and equipped with said substrate at a part thereof, said second ink tank and said substrate being integrally constituted by insert molding; and a first ink tank which stores the ink to be fed to said second ink tank of said ink jet head.

Still another object of the present invention is to provide an ink jet recording apparatus comprising:

an ink jet head, said ink jet head having a substrate and a ceiling plate constituting discharge ports for discharging ink and ink passages which become pathways for the ink discharged from the discharge ports, said substrate having a heat energy generating member for generating heat energy to be utilized for discharging of ink;

an ink storage portion which stores ink discharged from said discharge ports, and also is equipped with said substrate at a part thereof, said ink storage portion and said substrate being insert molded to be constituted integrally;

and a conveying means for conveying a recording medium member for forming an image with the ink discharged from said ink jet head.

Further, another object of the present invention is to provide a recording head equipped with a heat transmitting member transmitting a part of the heat energy generated by said heat energy generating member under the state bonded integrally to the opposite side surface to said ink passage forming surface of said substrate, made to have an integral constitution with said ink storing portion by insert molding, said substrate and said heat transmitting member being insert molded under the state where at least a part of said heat transmitting member is contactable with the ink in said ink storing portion.

DESCRIPTION OF THE PREFERRED EMBODIMENT

Figure 1:
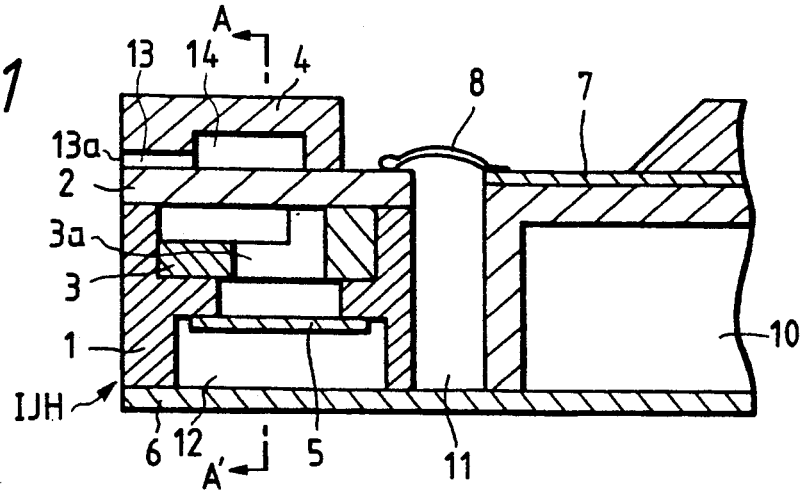
FIG. 1 is a side sectional view of the ink jet head according to the present invention.
Figure 2:
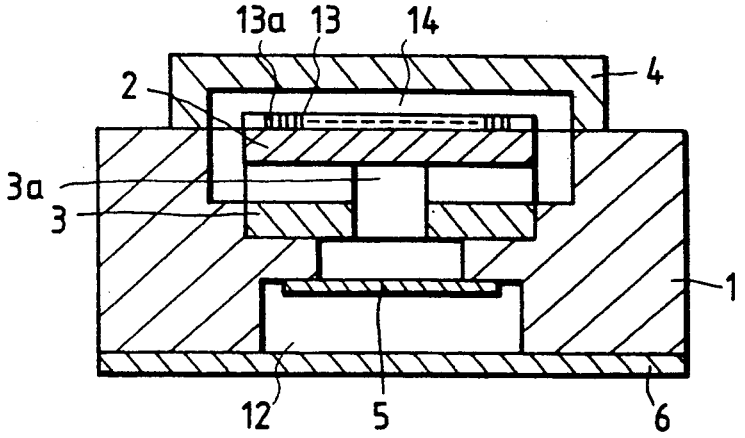
FIG. 2 is a sectional view taken along the A–A′ surface in FIG. 1.

Referring now to the drawings, the present invention is described in detail. FIG. 1 and FIG. 2 show a constitutional example of the ink jet head to which the present invention can be suitably applied. FIG. 1 shows a side sectional side view, and FIG. 2 a sectional view taken along the A–A′ plane in FIG. 1.

The ink jet head IJH to which the present invention is applicable is a head of the bubble jet system which performs recording by use of an electrothermal transducer which generates heat energy for forming film boiling to ink corresponding to electrical signals.

In FIG. 1 and FIG. 2, 2 is a heater board comprising electrothermal transducers (discharging heaters), (not shown) arranged in a plural number of arrays arranged on the Si substrate and electrical wirings (not shown) for feeding power thereto formed by film formation technique. 7 is a wiring substrate for the heater board 2, having a wiring corresponding to the heater board (for example, connected with wire bonding 8), and a pad (not shown) receiving the electrical signals of the main apparatus. The mode of electrical connection is not limited to this, but can take a constitution connected through an anisotropic material or the conventional modes of electrical connection.

4 is a grooved ceiling plate provided with partitioning walls for sectionalizing respectively a plurality of ink passages 13 and the common liquid chamber 14 for housing ink for giving ink to the respective ink passages 13.

The second ink tank 1 becomes the structure of the whole ink jet head IJH, with the back lid 6 being adhered or solvent welded, to form the first ink tank 10. Ink from the first tank 10 passes through the ink feeding portion 11 to be led into the ink reservoir portion 12 provided with the filter 5. The filter 5 removes impurities such as dust, etc. which may be mixed in the ink, and when the ink already passed through a filter is introduced, it is not necessarily provided. Ink passes through the filter 5 and then through the ink conduction hole 3*a* provided at the heat transmitting member 3. Further, ink contacts the lower surface of the heater board and, turning around the side surface, is led to the ink chamber 14, the ink passage 13 formed by bonding of the heater board 2 and the ceiling 4. And, based on the desired signals, ink is heated by the heater (heat-generating resistance member, not shown) provided on the heater board 2 corresponding to the ink passage 13 to form bubbles, which cause droplets to be discharged forwardly of the discharge opening 13 formed at the tip of the ink passage 13 to form a desired image on the recording medium. Here, the heat transmitting member 3 is a member having the effect of transmitting the heat generated at the heater board 2 during recording and accumulated without utilization for discharging into ink, and from the standpoint of transmission of heat, it may be preferably a material made of a metal. The ink feeding route from the first ink tank 10 to the ink passage 13 of the recording head is not limited to the above example, but a hole may be formed at the liquid chamber portion of the heater board 2 to make an ink introduction inlet, or alternatively the constitution may be made such that an ink feeding passage may be specially provided from the ink storage portion 12, and a hole formed at the ceiling plate 4 to form an introducing inlet for introducing ink from the ceiling plate side.

As shown in FIG. 1 and FIG. 2, in the ink jet head of the present invention, during molding of the second ink tank 1 with a moldable resin forming the second ink tank 1, the heater board 2 and the heat transmission member 3 are insert molded at a part within the ink passage from the ink reservoir portion 12 to the common chamber 14. By thus insert molding the heater board 2 and the heat transmission member 3, the positional precision of the heater board at the head can be improved, whereby there is no variance between a plural number of recording heads in the case of performing shade recording or full-color recording to enable recording of high precision. Also, by insert molding, ink leakage from the bonded surface between the ink passage portion and the heat transmission member or the heater board can be well prevented. The resin for forming the second ink tank in this case is filled after registration of the heater board 2 and the heat transmission member 3 so as to be closely contacted with each other. Since the heater board 2 and the heat transmission member 3 are subjected to registration under close contact, the heat accumulated in the heater board 2 can be transmitted with good efficiency to the heat transmission member 3. Also, by making the constitution of the heat transmission member in direct contact with the ink as in this example, the heat can be transmitted into the ink to transmit the heat accumulation in the heater board, and also utilized for control of the ink temperature by preventing lowering of ink temperature.

The moldable resin for forming the second ink tank 1 may include polyether sulfone, polysulfone, polyether ketone, polyphenylene sulfide, polyethylene terephthalate, polybutylene terephthalate, Noryl, ABS resin, acrylic resin, polycarbon, polyethylene, polypropylene, etc. as representative materials. Otherwise, those obtained by synthesizing various materials so as to give materials to obtain desired characteristics may be employed. As the heat transmission member 3 for transmitting the heat accumulated in the heater board 2 to another region, those of the material having ink resistance when directly contacted with ink and/or affecting no deleterious influence on ink, and also having good thermal conductivity, for example, metal materials, specifically titanium or noble metals (gold, silver, platinum, palladium, etc.) and alloys containing these atoms, stainless steel, etc. can be used.

Figure 3:
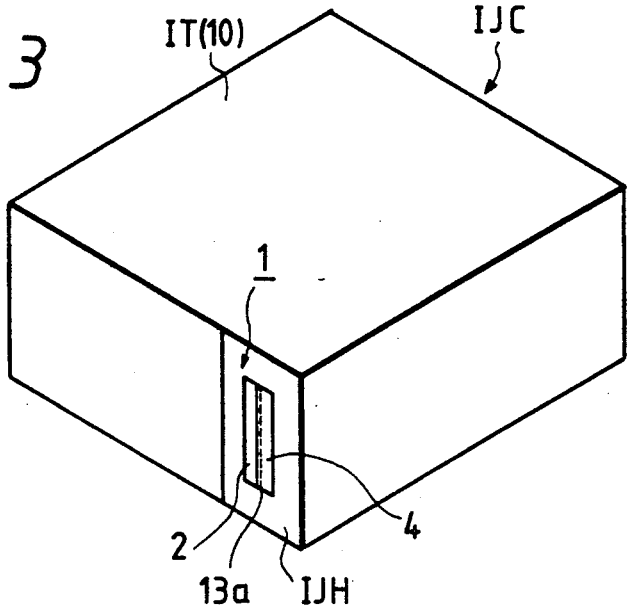
FIG. 3 is a perspective view of appearance showing an example of the ink jet cartridge according to the present invention.
Figure 4:
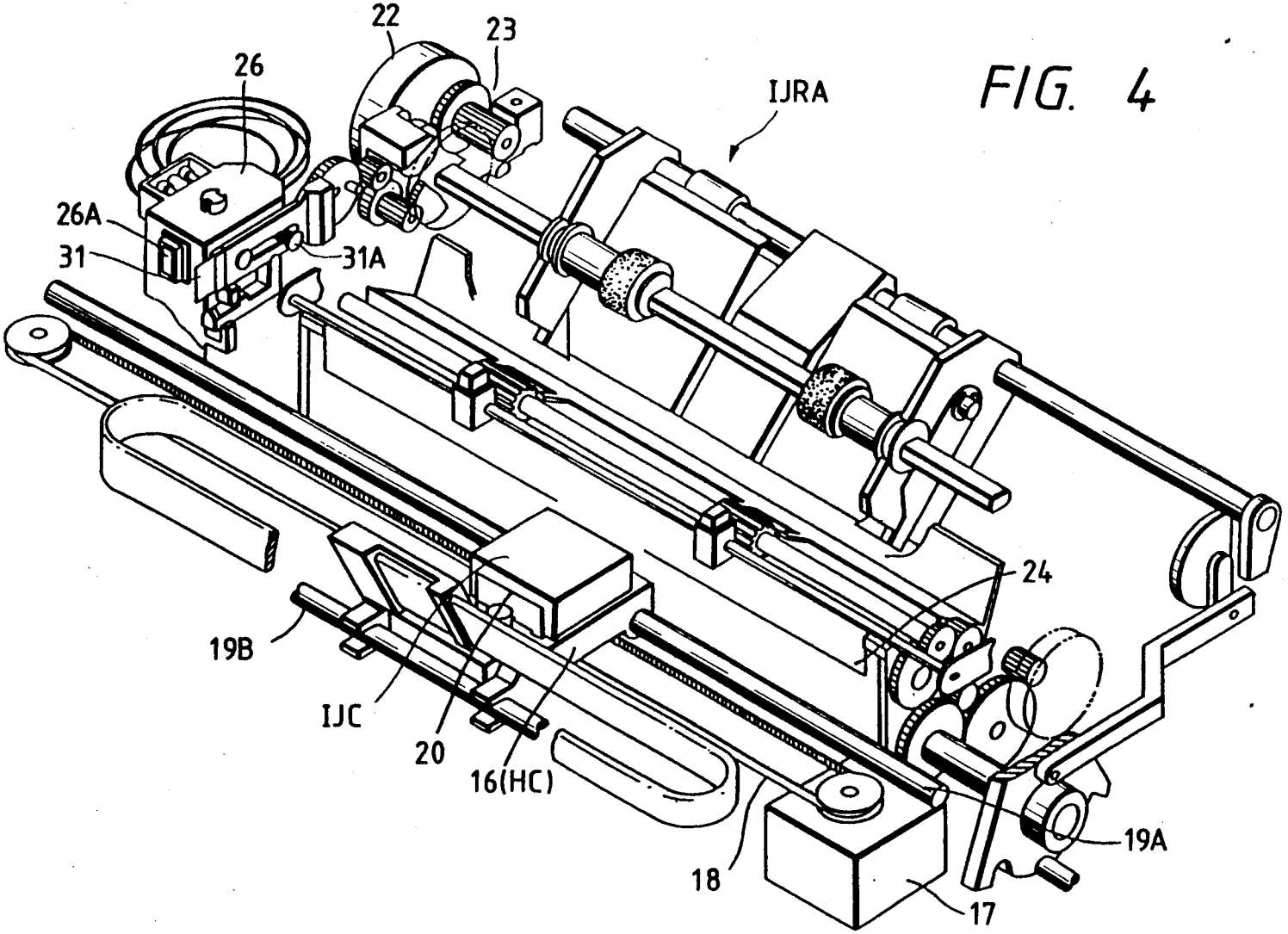
FIG. 4 is a perspective view of appearance showing an example of the ink jet recording apparatus according to the present invention.
Figure 5:
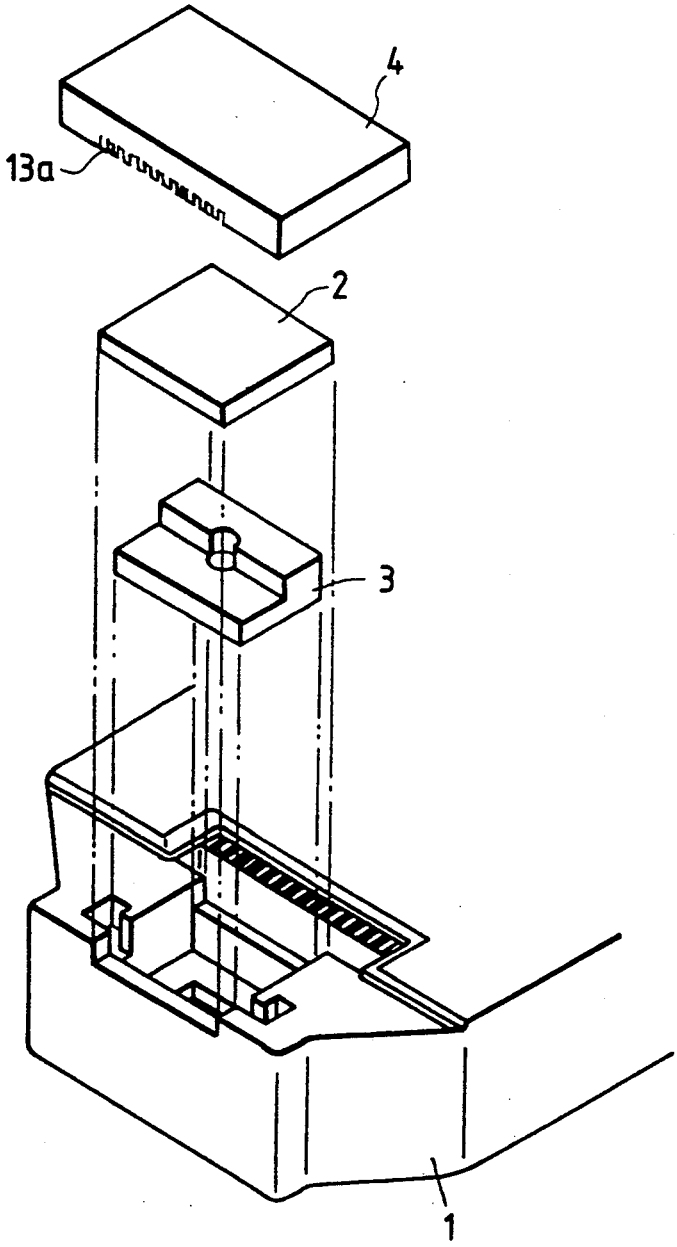
FIG. 5 is a perspective view of a related art example before assembling.
Figure 6:
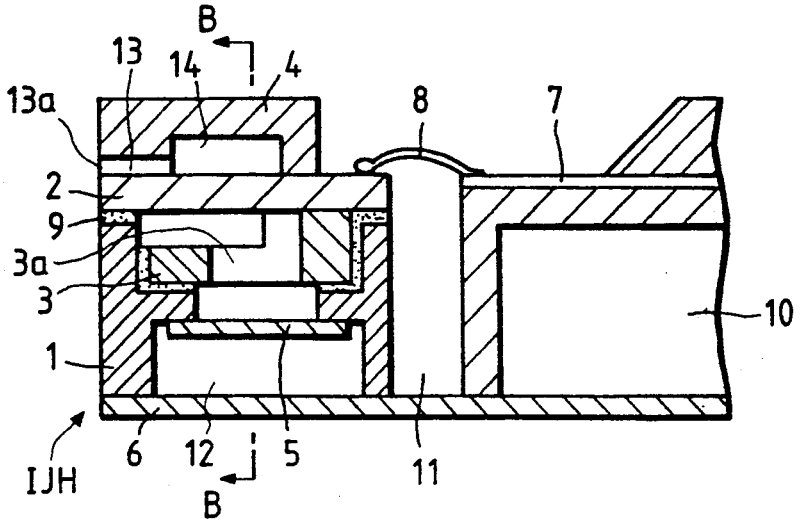
FIG. 6 is a side sectional view of a related art example.
Figure 7:
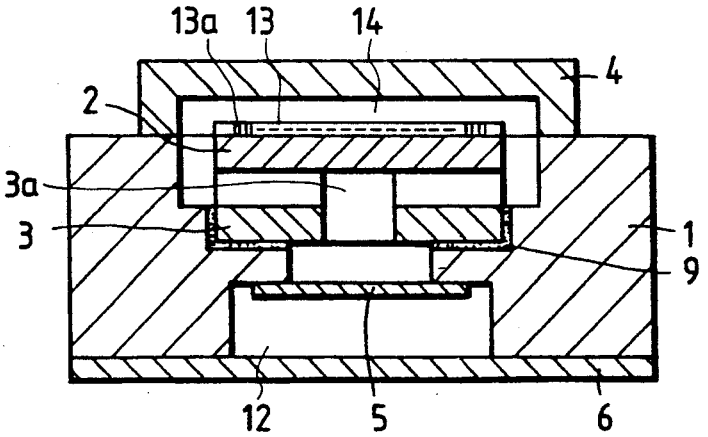
FIG. 7 is a sectional view taken along the plane B–B′ in FIG. 6.

FIG. 3 and FIG. 4 are illustrations for explanation of the ink jet cartridge IJC and the main ink jet recording apparatus IJRA, respectively, suitable for practice or application of the ink jet head IJH as described above. In the following, description is made by use of these drawings.

The ink jet cartridge IJC in this example, as can be seen from the perspective view in FIG. 3, has a shape having the tip portion of the ink jet head IJH slightly protruded from the front surface of the ink tank IT. The ink jet cartridge IJC is fixed and supported on the carriage mounted on the main ink jet recording apparatus IJRA and also is of the disposable type detachable relative to said carriage.

The first ink tank IT 10 storing the ink to be fed to the ink jet head IJH is constituted of a vessel for inserting an ink absorbing member and a lid member for sealing this (both not shown).

In the ink tank IT 10 is filled ink, and ink is fed successively to the ink jet head side corresponding to discharging of ink.

In this example, the ceiling plate 4 uses a resin excellent in ink resistance, such as polysulfone, polyether sulfone, polyphenylene oxide, polypropylene, etc.

The ink jet cartridge IJC constituted as described above is mounted freely detachably according to a predetermined method on the carriage HC of the ink jet recording apparatus IJRA as described below, and controls relative movement of the carriage HC and the recording medium by the predetermined recording signals, to form desired recorded images.

As described above, FIG. 4 is a perspective view of appearance showing an example of the ink jet recording apparatus IJRA equipped with the mechanism for the above treatment.

In the Figure, 20 is the ink jet head cartridge IJC equipped with the group of nozzles for performing ink discharging as opposed to the recording surface of a recording paper fed onto the platen 24. 16 is the carriage HC for holding the recording head 20, and by connecting to a part of the driving belt 18 which transmits the driving force of the driving motor 17, and being made slidable with the two guide shafts 19A and 19B arranged in parallel to each other, reciprocal movement of the recording head 20 over the entire width of the recording paper is rendered possible.

26 is a head restoring device, and is arranged at one end of the moving route of the recording head 20, for example, at the position opposed to the home position. By the driving force of the motor 22 through the transmission mechanism 23, the head restoring device 26 is actuated to perform capping of the recording head 20. In connection with the capping onto the recording head 20 by the cap portion 26A of the head restoring device 26, ink aspiration by a suitable aspiration means provided in the head restoring device 26 or ink pressure delivery by a suitable pressurization means provided in the ink feeding route to the recording head 20 is peformed to discharge compulsorily ink through the discharge ports, thereby effecting discharge restoration treatment such as removal of thickened ink in the nozzles, etc. Also, the recording head can be protected by application of capping on completion of recording, etc.

31 is a blade as the wiping member formed of a silicone rubber arranged at the side surface of the head restoring device 26. The blade 31 is held in the form of cantilever by the blade holding member 31A, actuated by the motor 22 and the transmission mechanism 23 similarly as the head restoring device 26, whereby engagement of the recording head 20 with the discharge surface becomes possible. By this, at an adequate timing in the recording actuation of the recording head 20, or after the discharge restoration treatment by use of the head restoring device 26, by protruding the blade 31 into the movement route of the recording head, dew formed, wetting or dust, etc. at the discharge surface of the head 20 is wiped off as accompanied with the movement actuation of the head 20.

During insert molding, it is preferable to perform molding while ensuring the ink passage by supporting the heater board from above and the heat transmission member from below.

Also, the ink jet head may have a constitution equipped only with the second ink tank as the ink storage portion for leading ink to the common liquid chamber, with the first ink tank which is the main as separate body. In other words, the ink reservoir portion 12 forming the heater board 2 and the heat transmission member 3 by insert molding may be constituted as the main tank (first tank) or sub-ink tank (second tank), and the effect of the present invention can be sufficiently obtained.

The present invention is described in more detail by referring to Examples.

EXAMPLE 1

While supporting the upper surface, the discharging surface and the rear end of the heater board 2 (7×4.7×0.5 mm) from above, and the center hold (1.2 mm) of the heat transmission member made of SUS (7×5×3 mm) and the surface in contact with the ink passage so that the heater board and the heat transmission member may be closely contacted with each other, a polysulfone resin was filled and insert molding was performed to form the second ink tank 1, thus preparing an ink jet head of the head-tank integral form.

COMPARATIVE EXAMPLE 1

By use of the same heater board and the heat transmission member as in Example 1, the both were fixed by adhesion by use of an epoxy type adhesive for the first ink tank 1 as shown in FIG. 3 to prepare an ink jet head of the head-tank integral form.

By use of 50 each of the ink jet heads prepared as described above, the following evaluation tests were conducted.

Thermostat storage test: 50 each of the ink jet heads of Example 1 and comparative example 1 were stored in a thermostat storage vessel controlled to 60° C. for one month, and ink leakage of the ink jet head was observed. The results of evaluation are shown in Table 1.

TABLE 1

| | Ink leakage among 50 |
|---|---|
| Example 1 | 0 |
| Comparative example 1 | 5 |

As described above, according to the present invention, in a recording head of the type forming a heater board and a heat transmission member in an ink tank, since the heater board and the heat transmission are sealed with the resin constituting the ink tank without use of an adhesive, it has become possible to prevent completely ink leakage from the bonded face. Further, since registration is made directly to the ink tank without use of an adhesive, the positional precision of the heater board is improved very much. Therefore, high quality recording can be accomplished in performing recording by use of a plural number of recording heads (ink jet unit). In addition, no use of an adhesive has made it possible to simplify the production steps.

The present invention brings about excellent effects, particularly in the recording head, the recording apparatus of the bubble jet system among the ink jet recording systems.

Concerning its representative constitutions and principles, for example, those practiced by use of the basic principle disclosed in U.S. Pat. Nos. 4,723,129 and 4,740,796 are preferred. This system is applicable to both of the so called on-demand type and continuous type, but particularly in the case of the on-demand type, by applying at least one driving signal which gives abrupt temperature elevation in excess of nucleate boiling corresponding to the recording information to the electrothermal transducer arranged corresponding to the sheet or the liquid passage where liquid (ink) is held, heat energy is generated in the electrothermal transducer, thereby causing film boiling to occur on the heat acting surface of the recording head, consequently forming effectively the bubble in the liquid (ink) corresponding one by one to the driving signal. By discharging the liquid (ink) through the opening for discharging by growth, shrinkage of the bubble, at least one droplet is formed. By making the driving signal shaped in pulse, growth and shrinkage of the bubble can be effected instantly and adequately, discharging of the liquid (ink) particularly excellent in response can be more preferably accomplished. As the driving signal shaped in such pulse, those disclosed in U.S. Pat. Nos. 4,463,359 and 4,345,262 are suitable. Further excellent recording could be performed by employment of the conditions disclosed in U.S. Pat. No. 4,313,124 concerning the temperature elevation rate of the above-mentioned heat acting surface.

As the constitution of the recording head, in addition to the combination constitution of discharge port, liquid passage, electrothermal transducer (linear liquid passage or right angle liquid passage), the U.S. Pat. No. 4,558,333 disclosing the constitution having heat acting section arranged at the flexed region, and the constitution by use of U.S. Pat. No. 4,459,600 are also included in the present invention. In addition, the effects of the present invention are effective even when the constitution may be made based on Japanese Laid-open Patent Application No. 59-123670 disclosing the constitution having the common slit as the discharge portion of the electrothermal transducer or Japanese Laid-open Patent Application No. 59-138461 disclosing the constitution having the opening for absorbing the pressure wave of heat energy corresponded to the discharge portion.

Further, as the recording head of the full line type having the length corresponding to the width of the maximum recording medium which can be recorded by the recording apparatus, either of the constitution in which its length is satisfied by the combination of a plural number of recording heads as disclosed in the specifications as mentioned above or the constitution as one recording head integrally formed may be employed, but the present invention can further effectively exhibit the effects as described above. In addition, by being mounted on the main apparatus, the present invention is also effective in the case of a recording head of the freely exchangeable chip type which enables electrical connection to the main apparatus and feeding of ink from the main apparatus, or in the case by use of a recording head of the cartridge type provided integrally on the recording head itself.

Also, addition of restoration means, preliminary auxiliary means, etc. for the recording head is preferable, because the effects of the present invention can be further stabilized. Specific examples of these may include the capping means, the cleaning means, the pressurization or aspiration means, preliminary heating means by means of an electrothermal transducer, another heating element or a combination of these, preliminary discharging mode which performs discharging separate from recording, as effective means for performing stable recording. Further, as the recording mode of the recording apparatus, not only the recording of black, etc. as the main color, but also the recording head may be integrally constituted or a combination of a plurality of heads may be used, but the present invention is also very effective for an apparatus equipped with at least one of plural colors of different colors or fullcolor by color mixing.

We claim:

1. An ink jet recording head for discharging ink by utilizing thermal energy to form a desired image, said head comprising:

a substrate having a discharge port for discharging ink and an ink passage serving as an ink discharge path for ink discharged from said discharge port and having an energy generating element for generating the thermal energy;

an ink storage portion for storing ink; and a heat transmitting member constituting a part of an ink supply path communicating said ink storage portion with said ink passage, said heat transmitting member for transmitting heat to said ink storage portion, wherein said heat transmitting member is insert molded between said ink storage portion and said substrate.

2. An ink jet recording head according to claim 1, further comprising an array of plural ink passages and plural discharge ports, wherein said ink supply path supplies ink from different sides of said array of plural ink passages leading to said plural discharge ports.

3. An ink jet recording head comprising:

a substrate having discharge ports for discharging ink, ink passages providing pathways for ink discharged from said discharge ports and heat energy generating members for generating heat energy to be utilized for discharging ink from said discharge ports;

an ink storage portion for storing ink to be discharged from said discharge ports; and a heat transmitting member for transmitting a part of the heat energy generated by said heat energy generating member at a side of said substrate opposite a side thereof facing said ink passages, wherein said ink storage portion is insert molded as an integral structure with said substrate and said heat transmitting member in place and at least a part of said heat transmitting member is disposed for contacting ink in said ink storage portion.

4. An ink jet cartridge for discharging ink by utilizing thermal energy to form a desired image, said cartridge comprising:

an ink jet recording head including:

a substrate having a discharge port for discharging ink and an ink passage serving as an ink discharge path for ink discharged from said discharge port and having an energy generating element for generating thermal energy, an ink storage portion for storing ink, and a heat transmitting member constituting a part of an ink supply path communicating said ink storage portion with said ink passage, said heat transmitting member for transmitting heat to said ink storage portion, wherein said heat transmitting member is insert molded between said ink storage portion and said substrate; and an ink tank for storing ink to be supplied to said ink storage portion, said ink tank having disposed therein an ink absorbing member.

5. An ink jet cartridge according to claim 4, further comprising an array of plural ink passages and plural discharge ports, wherein said ink supply path supplies ink from different sides of said array of plural ink passages leading to said plural discharge ports.

6. An ink jet cartridge comprising:

an ink jet head including:

a substrate having discharge ports for discharging ink, ink passages providing pathways for ink discharged from the discharge ports and heat energy generating members for generating heat energy to be utilized for discharging ink from said discharge ports, an ink storage portion for storing ink to be discharged from said discharge ports, and a heat transmitting member for transmitting a part of the heat energy generated by said heat energy generating member at a side of said substrate opposite a side thereof facing said ink passages, wherein said ink storage portion is insert molded as an integral structure with said substrate and said heat transmitting member in place and at least a part of said heat transmitting member is disposed for contacting ink in said ink storage portion; and an ink tank for storing ink to be fed to said ink storage portion of said ink jet head.

7. An ink jet recording apparatus for discharging ink by utilizing thermal energy to form a desired image, said apparatus comprising:

an ink jet recording head including:

a substrate having a discharge port for discharging ink and an ink passage serving as an ink discharge path for ink discharged from said discharge port, and having an energy generating element for generating thermal energy, an ink storage portion for storing ink, and a heat transmitting member constituting a part of an ink supply path communicating said ink storage portion with said ink passage, said heat transmitting member for transmitting heat to said ink storage portion, wherein said heat transmitting member is insert molded between said ink storage portion and said substrate; and conveying means for conveying a recording medium on which an image is formed with ink discharged from said ink jet recording head.

8. An ink jet recording apparatus according to claim 7, wherein said energy generating element faces said ink passage and said heat transmitting member transmitting externally of said substrate a part of the heat generated by said thermal energy generating element at a side of said substrate opposite a side thereof facing said ink passage, said heat transmitting member being disposed for contacting ink in said ink storage portion.

9. An ink jet recording apparatus according to claim 7, further comprising an array of plural ink passages and plural discharge ports, wherein said ink supply path supplies ink from different sides of said array of plural ink passages leading to said plural discharge ports.

10. An ink jet recording apparatus according to claim 7, further comprising a recovery mechanism for maintaining or recovering a discharge condition of said ink jet recording head, said ink jet recording recovery mechanism having a cap member, a cleaning blade and a suction member.

11. An ink jet recording apparatus comprising:

an ink jet head including:

a substrate having discharge ports for discharging ink, ink passages providing pathways for ink discharged from the discharge ports and heat energy generating members for generating heat energy to be utilized for discharging ink from said discharge ports, an ink storage portion for storing ink to be discharged from said discharge ports, and a heat transmitting member for transmitting a part of the heat energy generated by said heat energy generating member at a side of said substrate opposite said ink passages, wherein said ink storage portion is insert molded as an integral structure with said substrate and said heat transmitting member in place and at least a part of said heat transmitting member is disposed for contacting ink in said ink storage portion; and conveying means for conveying a recording medium on which an image is formed with ink discharged from said ink jet recording head.

* * * * *